US005086605A

United States Patent [19]

Tzincoca

[11] Patent Number: 5,086,605

[45] Date of Patent: Feb. 11, 1992

[54] METHOD OF MOUNTING FLOORS IN A SHELL WHOSE CONCRETE WALL IS ERECTED BY A CONTINUOUS SELF-CLIMBING SHUTTERING INSTALLATION

[75] Inventor: Alexandre J. Tzincoca, Paris, France

[73] Assignee: Enterprise Generale Industrielle, France

[21] Appl. No.: 495,036

[22] Filed: Mar. 16, 1990

[30] Foreign Application Priority Data

Mar. 16, 1989 [FR] France ..... 89 03481

[51] Int. Cl.[5] ..... B28B 1/00; B28B 17/00; E04B 1/16; E04G 11/20

[52] U.S. Cl. ..... 52/745; 52/747; 249/20; 264/32; 264/33; 264/34; 264/35; 425/63; 425/65

[58] Field of Search ..... 52/745, 747; 249/19, 249/20; 425/63-65; 264/31-35, 69-72, 251, 253, 256, 259, 275, 278, 308, 333, 334

[56] References Cited

U.S. PATENT DOCUMENTS

| | | | |
|---|---|---|---|
| 1,701,113 | 2/1929 | Keller | 264/33 |
| 3,252,199 | 5/1966 | Bössner | 264/34 |
| 3,275,719 | 9/1966 | Dudson | 264/34 |
| 3,292,313 | 12/1966 | Entwistle | 52/745 X |
| 3,770,857 | 11/1973 | Haws | 264/33 |
| 3,804,320 | 2/1973 | Sommer et al. | 264/32 X |
| 4,016,228 | 4/1979 | Schmidt | 264/34 X |
| 4,249,870 | 2/1981 | Krabbe et al. | 264/33 X |
| 4,255,366 | 3/1981 | Zerna et al. | 264/35 |
| 4,301,630 | 11/1981 | Burkland | 52/745 X |
| 4,391,070 | 7/1983 | Bönnighausen | 52/745 X |
| 4,455,270 | 6/1984 | O'CadizCastaneda | 264/34 X |
| 4,540,150 | 9/1985 | Tzincoca | 249/20 |
| 4,619,433 | 10/1986 | Maier | 264/32 X |
| 4,709,899 | 12/1987 | Kajioka et al. | 264/35 X |
| 4,717,517 | 1/1988 | Halberstadt | 264/35 X |
| 4,768,938 | 9/1988 | Greeson | 264/33 X |
| 4,824,350 | 4/1989 | Sommer et al. | 264/32 X |
| 5,012,627 | 5/1991 | Lundmark | 264/33 X |

*Primary Examiner*—Karen D. Aftergut
*Attorney, Agent, or Firm*—Larson & Taylor

[57] ABSTRACT

A method for mounting floors in a shell whose concrete wall is erected by a continuous self-climbing shuttering installation and a continuous self-climbing shuttering installation for implementing the method, includes appropriate vertical and horizontal movements of certain assemblies ($I_1$-$I_2$), ($I_3$-$I_4$) of self-climbing brackets (2) and of their shuttering and concreting walkways ($P_1$, $P_2$, $P_3$) so as to provisionally align the brackets (2, 2*b*) vertically in twos, and thus reduce the number of peripheral clearances to be provided in the floors to be laid at intervals inside the wall of the shell to be erected. The installation includes lateral transfer carriages (14, 14') providing the horizontal lateral transfers of the brackets, the vertical transfers being provided by the normal self-climbing system.

5 Claims, 12 Drawing Sheets

1
2
6
7
8
9
10
11
14'
21
22
23
24
30
M3
M4
B0
B1
B2
B3
B4

METHOD OF MOUNTING FLOORS IN A SHELL WHOSE CONCRETE WALL IS ERECTED BY A CONTINUOUS SELF-CLIMBING SHUTTERING INSTALLATION

The present invention relates first of all to a method of mounting floors in a shell whose concrete wall is erected by a continuous self-climbing shuttering installation.

The term "shell" used in the present application designates generally any structure with closed cross section, such as that of a column or a tower which may be of large size.

It may in particular be a question of hollow concrete columns of great height, which may have a very variable geometry and in particular great variations of diameter (high conicity), these columns being intended more specially, but not exclusively, for supporting drilling platform installations or installations for working offshore hydrocarbon deposits.

A self-climbing shuttering installation which can be used for erecting concrete walls of great height, particularly for erecting water cooling towers in electric power stations has been described in the European Pat. No. 108 697 in the name of the Applicant.

With the wall to be erected constructed by successive lifts along the periphery of the work until the desired height is reached, this known installation comprises essentially, on each face of the walls, means for momentarily fixing working walkways on an underlying portion of the wall already cast and hardened, means for shuttering the next lift on said underlying portion and climbing means for self-raising of the assembly of walkways. As for the fixing means in question, they comprise series of uprights extending substantially in mainly vertical planes and the lower uprights of which are anchored in the hardened concrete of the wall, these series being evenly spaced apart along the periphery of the wall, said uprights serving both as elements for holding the shuttering in position and as means for guiding and engaging self-lifting mobile brackets supporting said walkways.

Such an installation may be used substantially in the same way for erecting hollow columns of smaller diameter but of highly variable diameter, such as is the case of the columns of the above-mentioned platforms, requiring only a few dispositions particularly in setting up the walkways.

However, the erection of a hollow column wall, particularly for offshore platforms raises a specific problem, which is that the floors, which are intended to support different equipment, must be laid inside the column during erection of the wall—these floors being arranged in stages during such erection—and this when the upper part of the inner face of the wall, at the level of which part the floor is to be fixed, is (like the external face of this wall) occupied by shuttering, the uprights as well as the mobile self-lifting brackets and their walkways, which equipment is necessary for continuing the erection of the column above the floor once laid.

The essential purpose of the present invention is to solve this particular problem.

For this, and in its most general aspect, a method of mounting floors in accordance with the invention, when a self-climbing shuttering installation of the above defined type is used, will be essentially characterized in that, for such mounting, in the column or shell, of a floor having at its periphery a series of evenly spaced apart clearances, and considering the first assemblies and the third assemblies each comprising the brackets which are engaged on two adjacent series of internal uprights and the walkways supported by these brackets the following is the procedure:

the shuttering and concreting operations on the internal side of the wall are interrupted;

the walkways of each of the intermediate or second assemblies are laid on the walkways of one or other of the adjacent assemblies;

said third assemblies are lowered to a lower level than that of said first assemblies;

said third assemblies are transferred laterally under the first ones;

the floor to be fitted in the shell is positioned, said superimposed first assemblies and third assemblies then letting the corresponding clearances of the floor pass, and the floor may then be laid;

said first assemblies are transferred laterally to the respective positions which the third assemblies occupied previously;

said third assemblies are mounted to the respective positions which the first assemblies occupied previously; and the walkways of the intermediate assemblies are then repositioned, following which the shuttering and concreting operations may be continued until the next floor is laid.

Of course, to avoid a loss of time it will be advantageous for the different movements to be synchronized for all the groups of uprights, brackets and walkways spaced apart about the internal periphery of the wall of the shell, and comprising what was called above by convention a "first", a "second" and a "third" assembly, it being understood that the "second assemblies" are assemblies inserted each time between a first assembly and the following third assembly.

The present invention also relates to a continuous self-climbing shuttering installation for implementing the method which has just been described in its broad lines.

For this, the installation described at the beginning will be essentially characterized in that it comprises, on the one hand, means for laterally transferring third assemblies each comprising two adjacent brackets and their walkways, which makes it possible to transfer, under an adjacent first assembly, each third assembly after the latter has been brought back, by said climbing means, to a lower level than that of said first assembly, which makes it possible to position the floor and, on the other hand, means for laterally transferring the first assemblies, for transferring them to the respective positions occupied previously by said third assemblies, following which said climbing means permit said third assemblies to be mounted again to the respective positions occupied previously by said first assemblies.

Other details of the method and installation in accordance with the invention, as well as the operation thereof will now be described by way of example which is no ways limiting, with reference to the accompanying drawings in which.

Figures 11A, 11B, 11C, 11D, 11E:
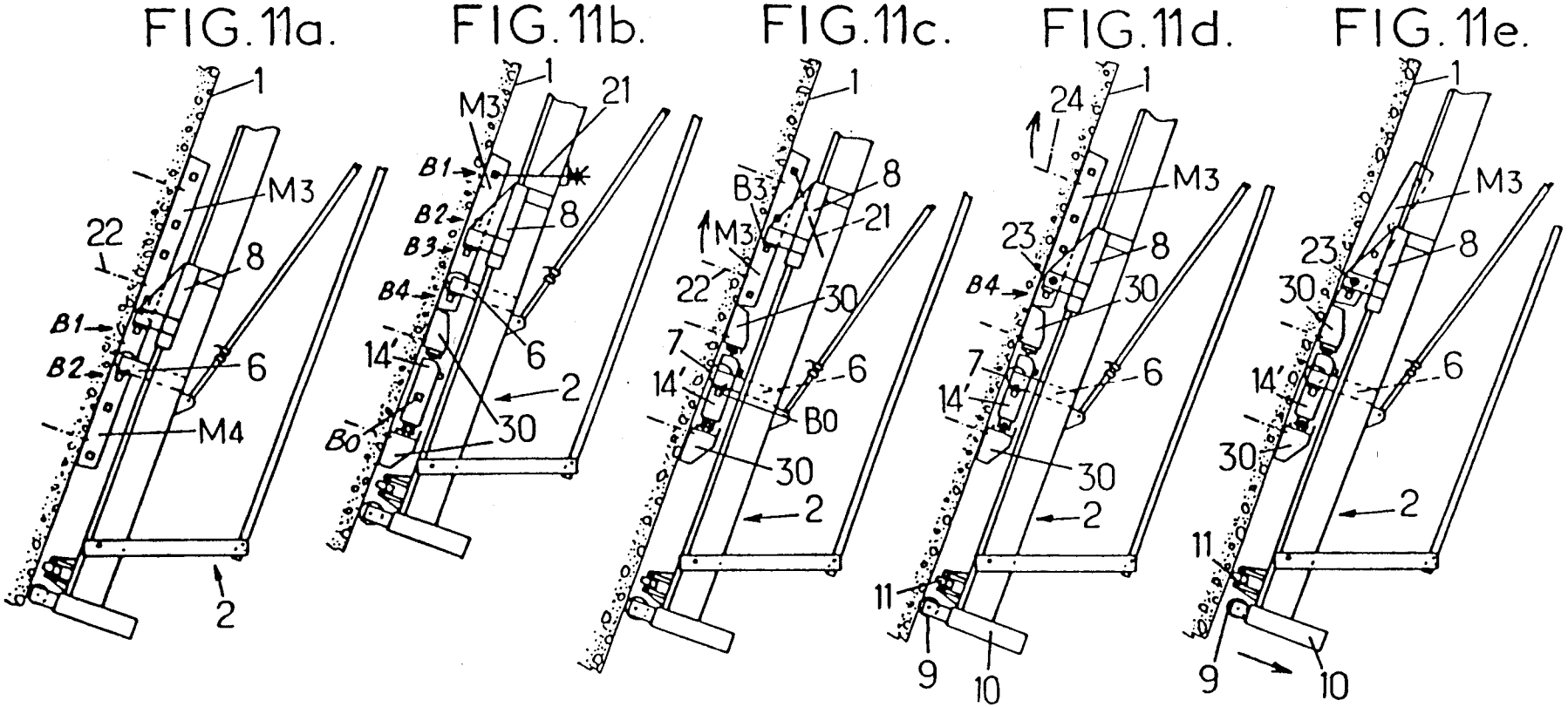
Figure 12:
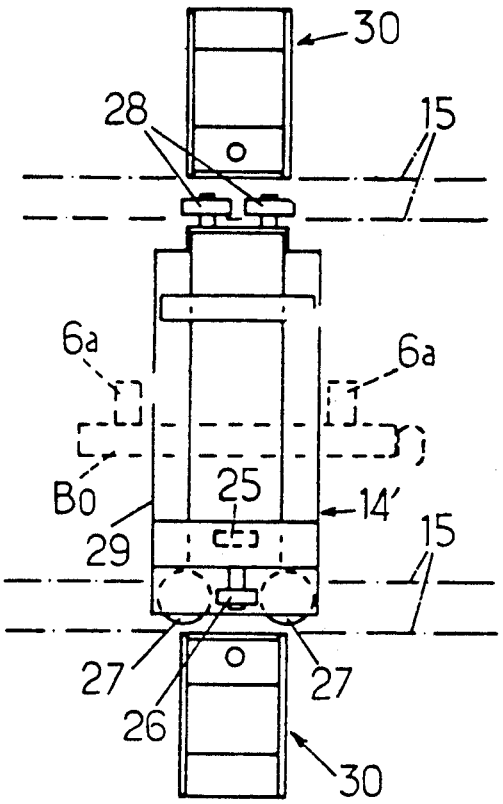
Figure 13:
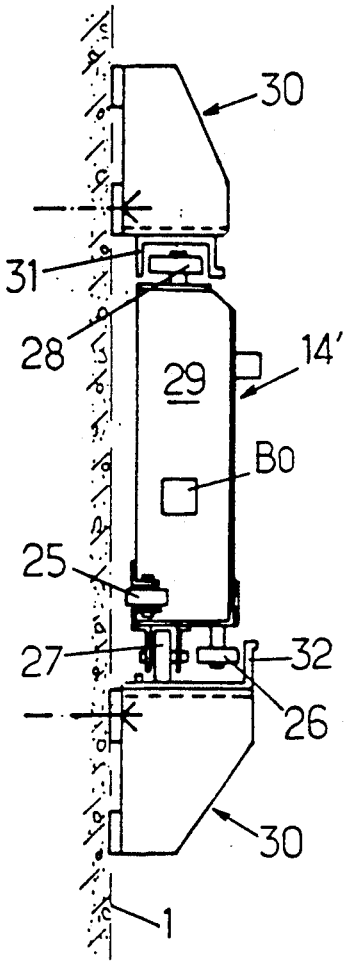
Figure 14:
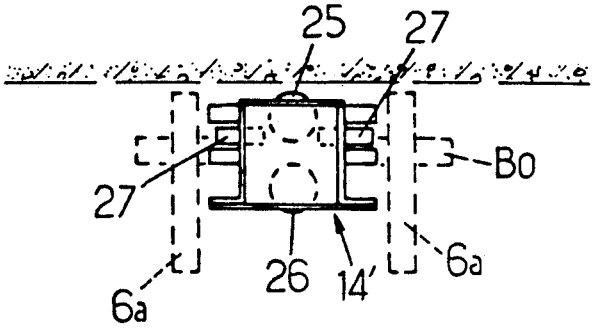

FIGS. 6*a* to 10*a* are schematic sectional views of the column during erection, showing the different phases preparatory to and after positioning a floor;

FIGS. 6*b* to 10*b* are the corresponding respective schematic plan views;

FIGS. 11*a* to 11*e* are schematic profile views showing the different preparatory operations for lateral transfer of the bracket assemblies; and FIGS. 12, 13 and 14 show in greater detail the transfer carriages, respectively in a front view, a profile view and a top view.

Figure 1:
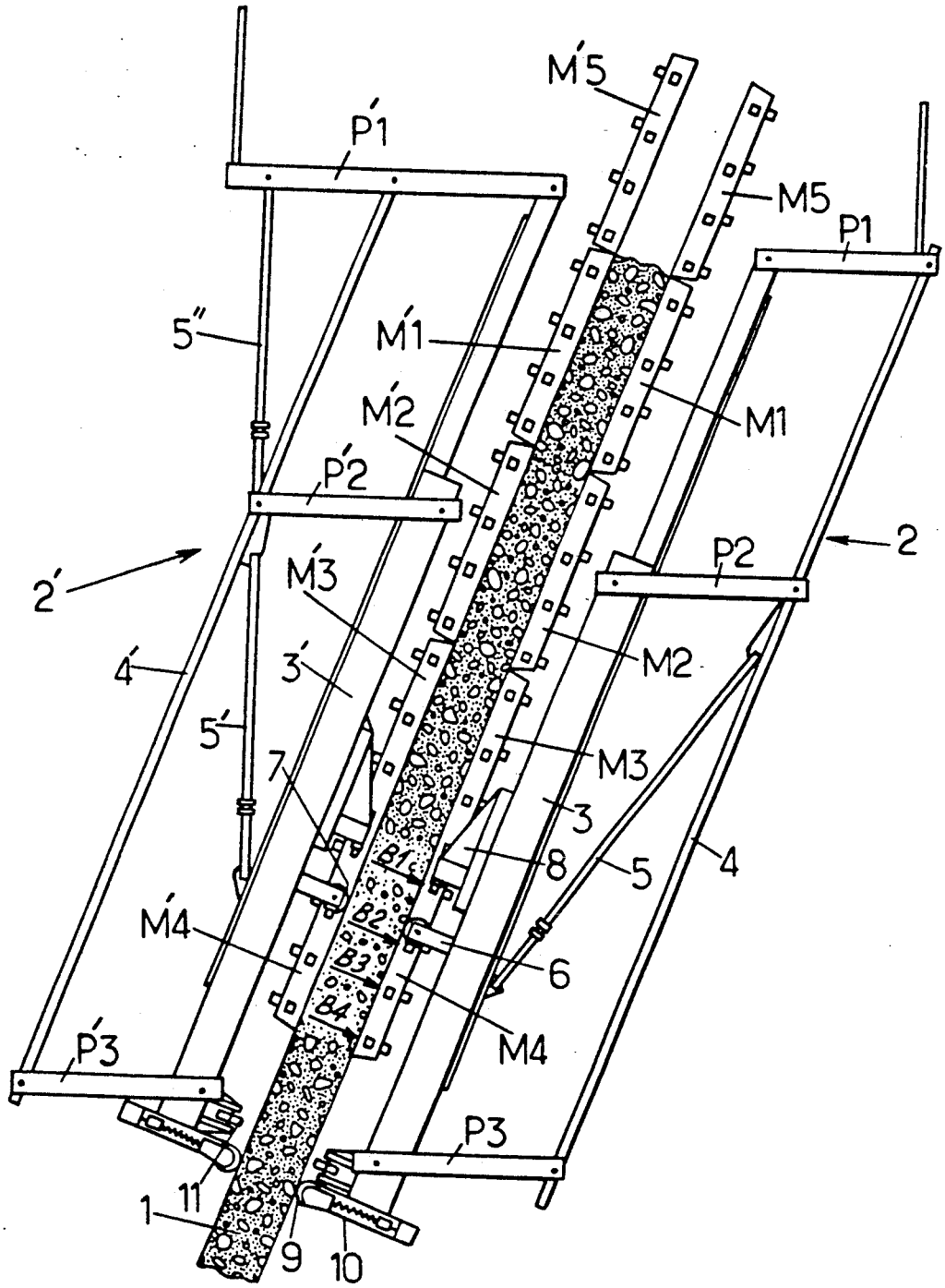
FIG. 1 shows in a profile view two self-climbing brackets disposed on each side of a hollow shell or column wall during erection.

In FIG. 1, the hollow concrete column wall being erected has been referenced 1. The uprights permitting the shuttering to be held in position and engagement and self-climbing of the brackets supporting the walkways have been referenced $M_1$ to $M_5$ on the internal side of the column (assumed to be at the right-hand side of the figure), and $M'_1$ to $M'_5$ on the external side. The uprights are thus spaced evenly apart in series of five over the internal and external peripheries of wall 1. The lower uprights $M_1$ to $M_4$ and $M'_1$ to $M'_4$ are anchored in the hardened concrete of the preceding lifts of the wall. In the figure, uprights $M_5$ and $M'_5$, fixed previously under the uprights $M_4$ and $M'_4$ have been assumed to be raised above uprights $M_1$ and $M'_1$, respectively, to allow the next casting.

In what follows, the brackets fastened on the internal series of uprights will be designated $I_1$, $I_2$, $I_3$ . . . and $I_n$; they may be offset by half a distance with respect to the brackets of the external series of uprights (not referenced), as was described in the above mentioned European Pat. No. 108 697. In a way also known from this patent, the different uprights are provided with means for accurately adjusting the slant thereof, both in the radial plane and in the plane tangential to wall 1, so as to be always able to control the form, slant and thickness of wall 1 during erection; it is not necessary to describe again these means here, neither the detailed construction of the uprights, which only differs little from the uprights of the known installation. It should however be noted that each upright comprises, for climbing of the brackets, four transverse pinning holes, which have been referenced $B_1$, $B_2$, $B_3$ and $B_4$ on the lower and internal upright $M_4$, these references may designate either the pins or the holes which receive them.

The brackets, referenced generally 2 and 2', are in the form of deformable articulated parallelogram metal structures for following the slope of wall 1.

Each bracket comprises two main front longitudinal members 3 and 3' connected for articulation, by support cross pieces, to rear secondary longitudinal members 4 and 4'; the brackets are reinforced by adjustable struts 5 and 5'. For each bracket, said support cross pieces carry three levels of working and/or material or equipment storage walkways, respectively $P_1$, $P_2$, $P_3$ and $P'_1$, $P'_2$, $P'_3$. It can be seen that the upper and external walkway $P'_1$ is widened, with respect to the upper and internal walkway $P_1$; it is also reinforced, and braced by an adjustable extension 5" of the strut 5', so as to be able to support if required the weight of a storage zone as well as the weight of concrete buckets, a running track (not shown) being provided on this walkway $P'_1$.

Turning now to the internal bracket 2 (in so far as the following arrangements are concerned, the external bracket 2' will be formed in the same way), its front longitudinal members 3 each have a fixed rest 6 equipped with a pair of support rollers 7 with horizontal axis, and serve at the same time as slides for a mobile rest 8, which can be actuated for example by a rotary screw driven by a motor. In FIG. 1, it can be seen that the fixed rest 6 bears on pin $B_2$ and the mobile rest 8 on pin $B_1$, of the lower upright $M_4$. Here again, it will not be necessary to describe the self-climbing sequences of the brackets, which involves in particular alternate bearing of the fixed and mobile rests on the defined pins of the uprights, since they have been amply described in the above mentioned European patent.

The support rollers 7 permit the fixed rests 6 to accommodate the horizontal forces exerted on bracket 2 and transmit them to the main corresponding upright, in this case $M_4$. The mobile rest 8, since it is not urged in the horizontal direction, has no rollers; it only withstands the loads parallel to wall 1, during the climbing movement. On the other hand, for adjusting the position of bracket 2 with respect to wall 1, a roller 9 has been provided at its lower part associated with a screw adjustment system 10, which can be actuated from walkway $P_3$. On the other hand, to permit lateral translational movements of which it will be a question hereafter, the bracket has a horizontally moving roller 11 also in its lower part.

An essential part of the installation being thus described, the principle of the movements will now be described which the brackets will have to make when it is a question of fitting a floor in the column under construction, with reference to FIGS. 2 to 10*b*.

Figure 2:
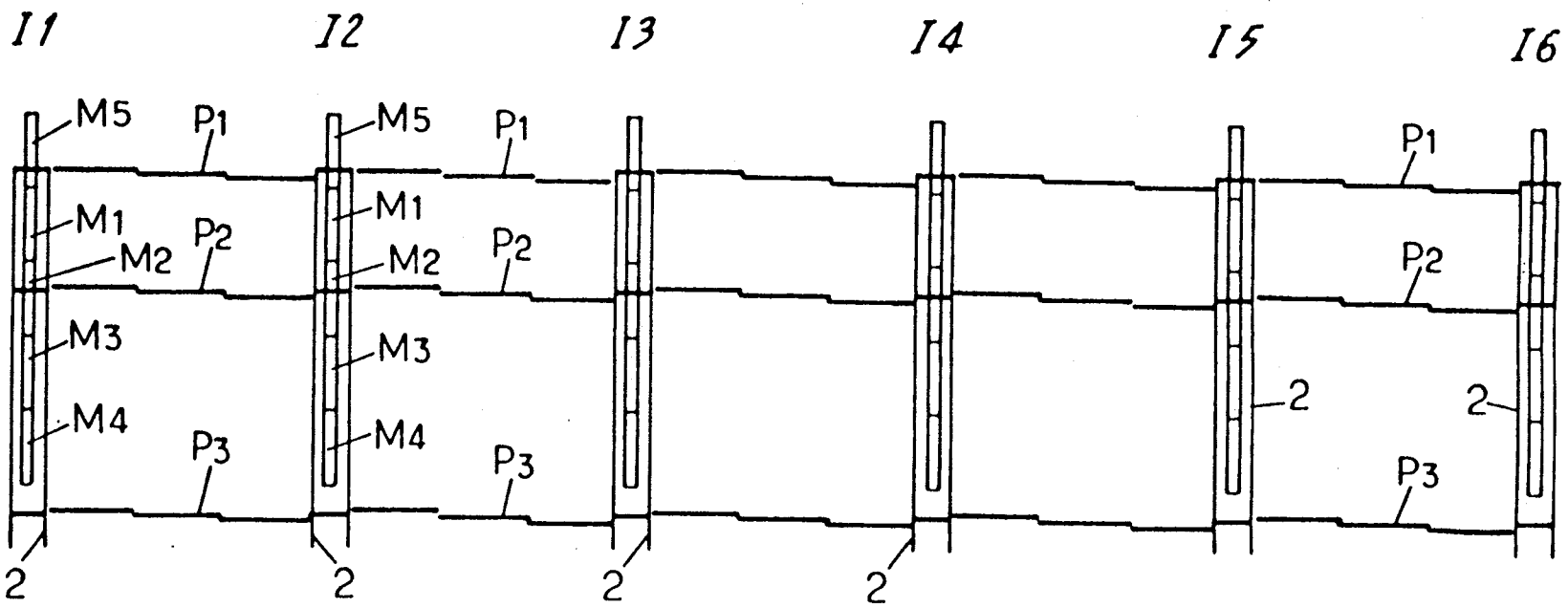
FIGS. 2 to 5 are schematic front views showing the different movements of the bracket assemblies on the internal face of the wall of the shell for letting a floor pass.
Figure 6B:
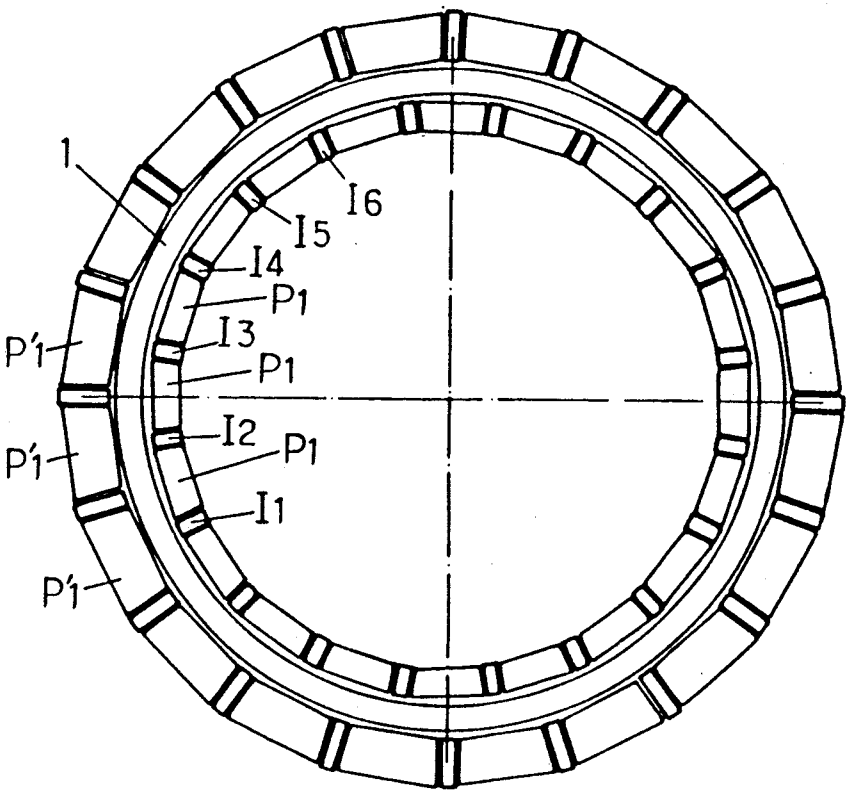
Figure 6A:
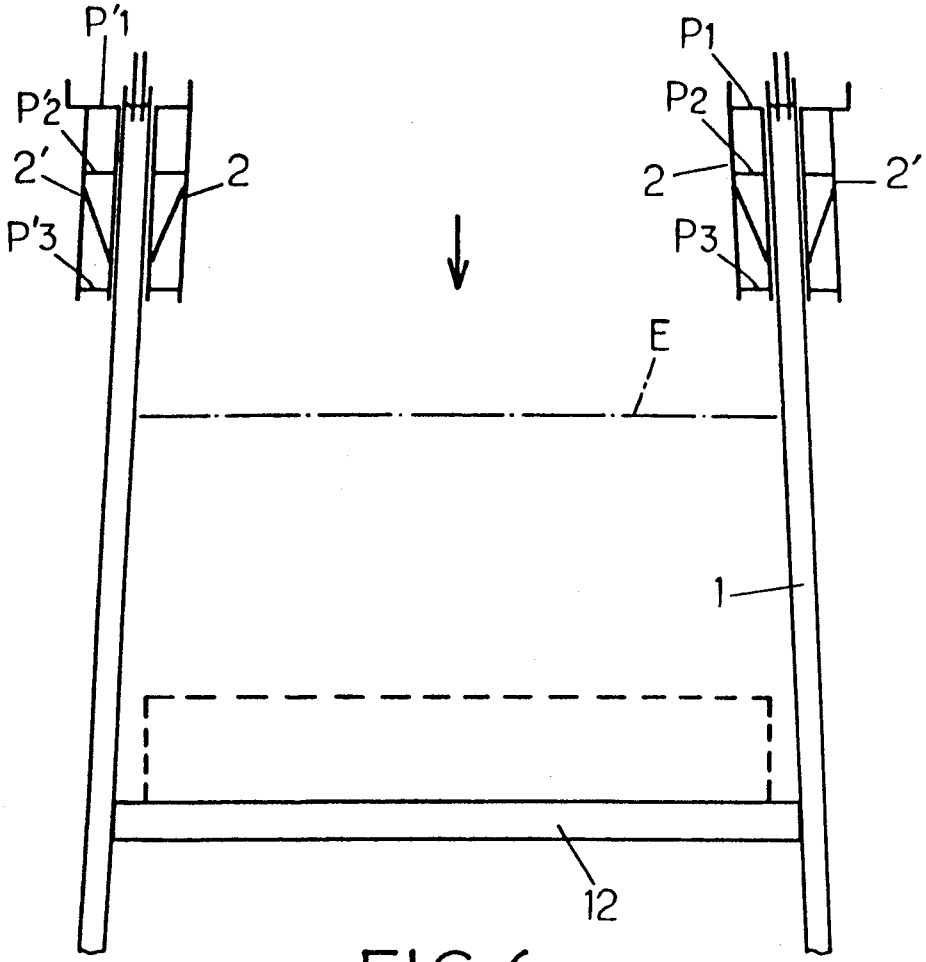

FIGS. 2, 6*a* and 6*b* show brackets 2 and 2' and their walkways $P_1$, $P_2$, $P_3$ and $P'_1$, $P'_2$, $P'_3$ in the normal working position. It has been assumed that the position E (FIG. 6*a*) where a floor 13 is to be laid similar to floor 12 already laid lower down and equipped, it is necessary, in this example to use, on the inside (and on the outside), twenty series $I_1$, $I_2$, . . . $I_n$ of brackets and uprights $M_5$, $M_1$, $M_2$, $M_3$, $M_4$ and so as many sets of three walkways $P_1$, $P_2$, $P_3$ and $P'_1$, $P'_2$, $P'_3$. It can be seen in FIG. 6*b* that the series of internal uprights and brackets are offset angularly by half a distance with respect to the external series of uprights and brackets.

In FIG. 2, only six series $I_1$ to $I_6$ to five inner uprights and their brackets have been shown, the movements—described below—of the first assemblies such as $I_1$-$I_2$ and of the third assemblies such as $I_3$-$I_4$ being the same for the following assemblies, namely the first assemblies $I_5$-$I_6$ . . . and the third assemblies $I_7$-$I_8$ . . . along the internal periphery of wall 1.

Figure 3:
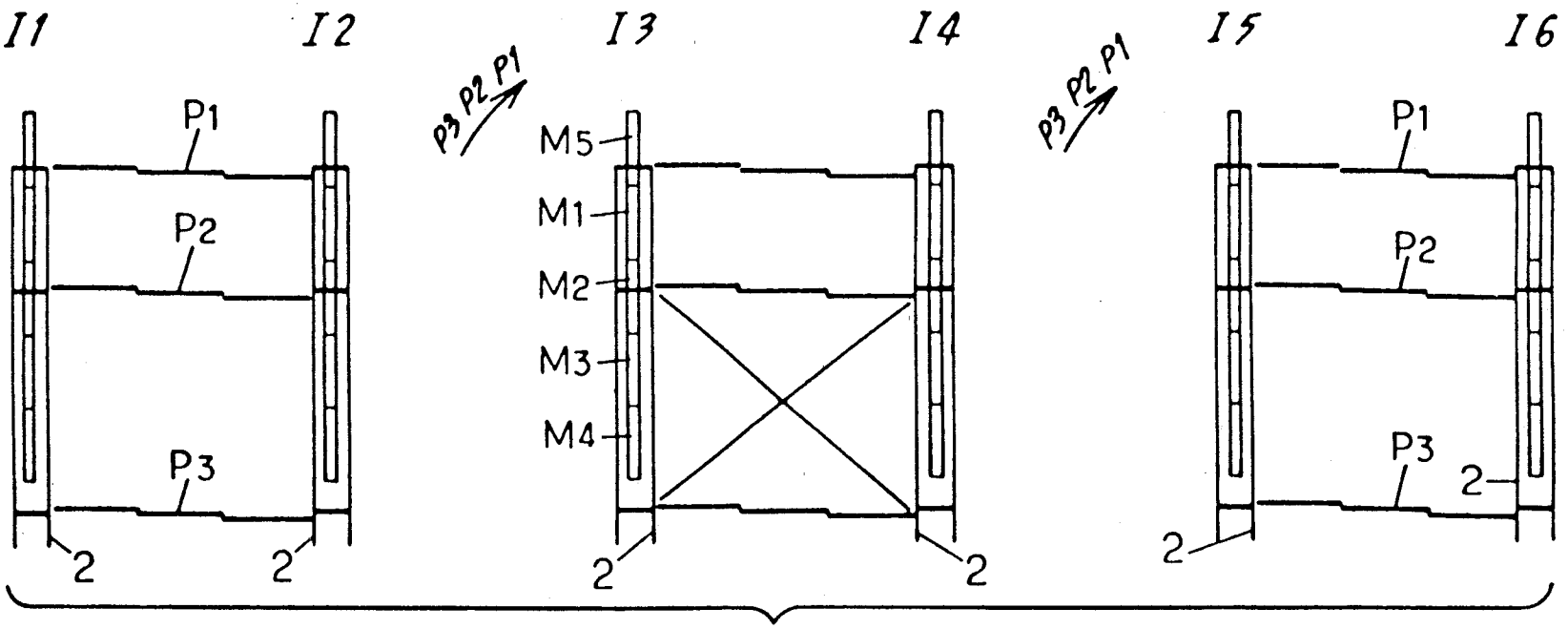

The procedure is then the following :

the shuttering and concreting operations on the internal side of wall 1 are interrupted, it being understood that such operations may be continued over a small height, from the external face. Then walkways $P_1$ to $P_3$ of the second assembly $I_2$-$I_3$ are laid on those of the adjacent third assembly $I_3$-$I_4$, and similarly the walkways $P_1$ to $P_3$ of the next intermediate assembly $I_4$-$I_5$ on those of the next first assembly $I_5$-$I_6$ and so on (FIG. 3).

Figure 4:
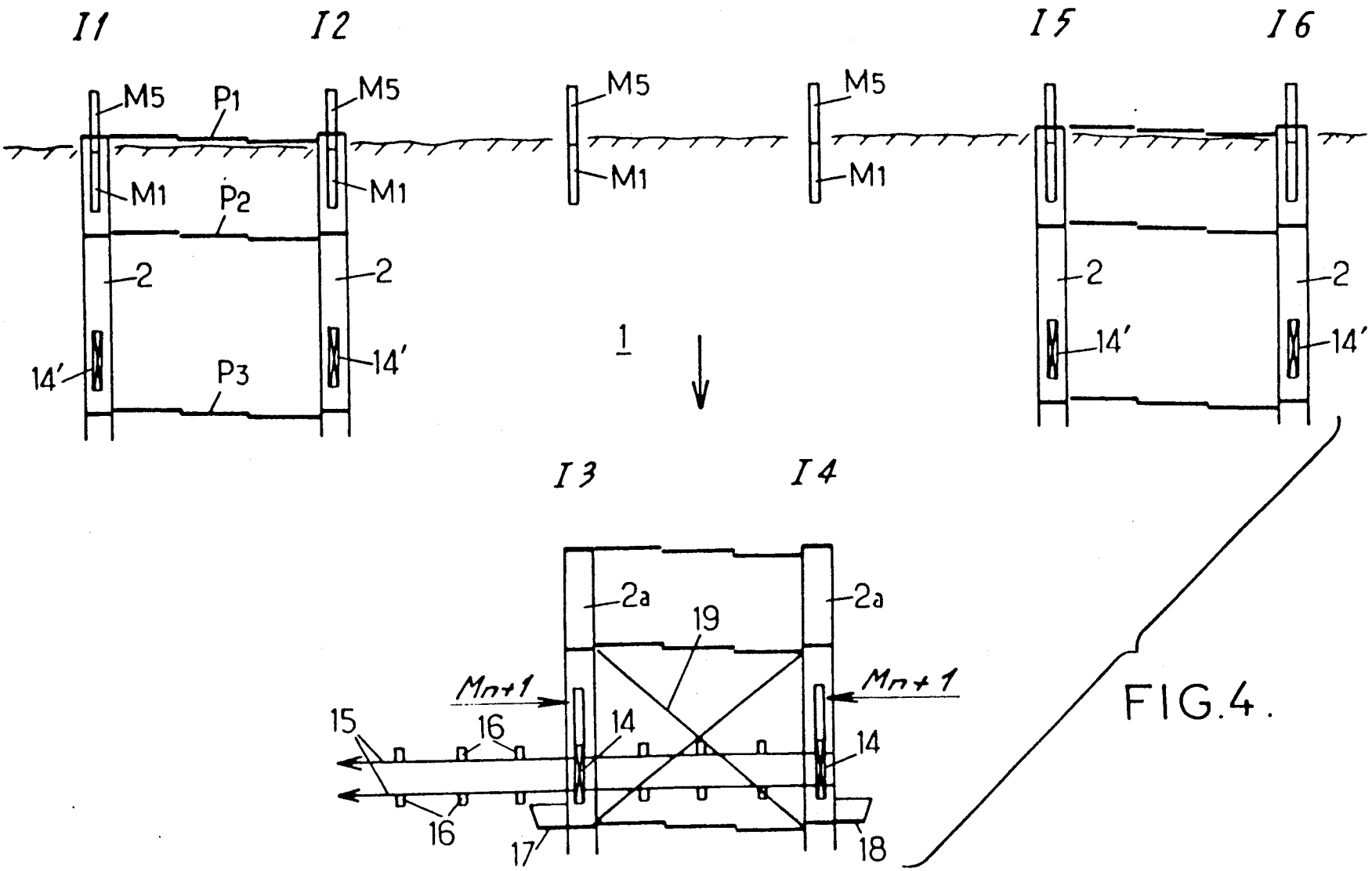
Figure 7B:
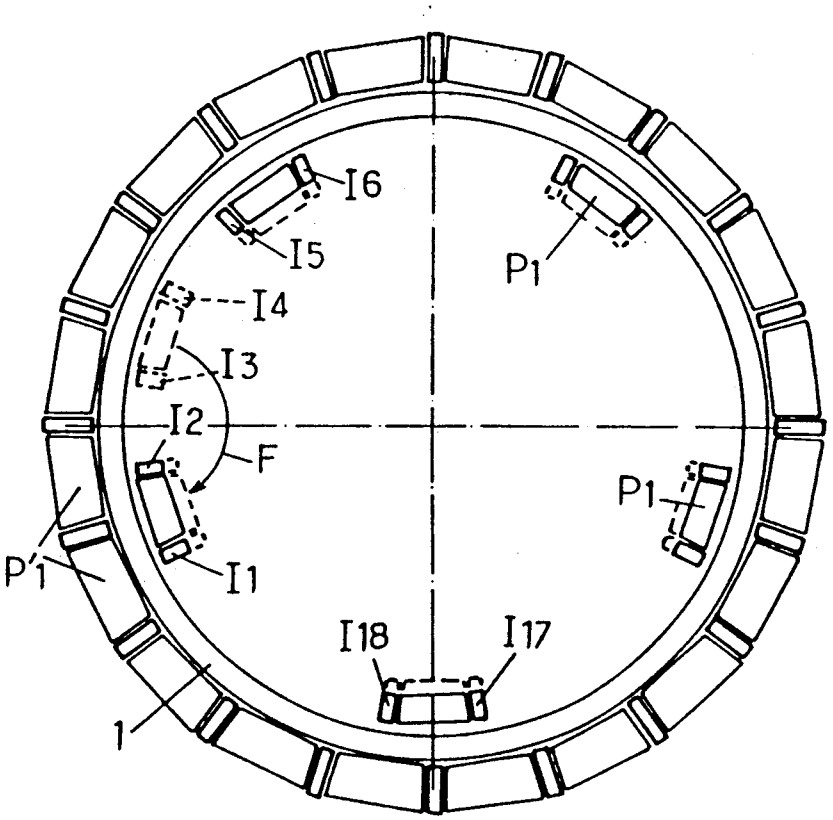
Figure 7A:
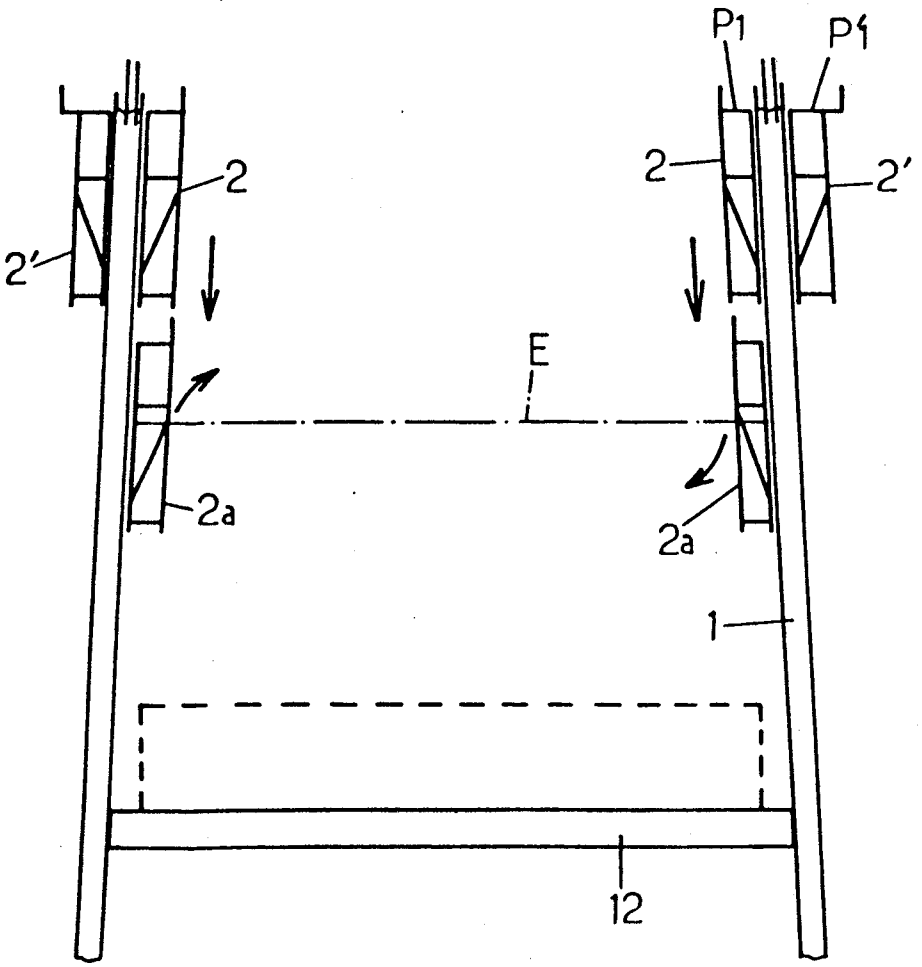

After removing their cross-bracing 19, the brackets 2 of the third assembly $I_3$-$I_4$ are lowered to bring them into the position referenced 2*a*, as shown in FIGS. 4, 7*a* and 7*b*, in which position the cross-bracing 19 is replaced.

For this, the connection between uprights $M_1$ and $M_2$ is suppressed and brackets 2 are lowered to their lower level 2*a* while successively adding additional uprights under the lower uprights $M_4$ and using, in the downward direction, the fixed 6 and mobile 8 bracket climbing system described above, the upper uprights $M_5$ and $M_1$ remaining in position on wall 1. The last uprights thus laid for the downward movement have been referenced Mn+1 in FIG. 4. Above the latter, instead of the uprights, lateral transfer carriages 14 are mounted for running over lateral shift rails made from stamped metal sheet 15, which are fixed to wall 1 by fixing shoes 16. At 17 and 18 in FIG. 4 have also been shown a front nose and a rear nose which allow the shoes 16 and rails 15 to be mounted then removed as the third assembly $I_3$-$I_4$ is shifted leftwards in FIG. 4.

At the same time, uprights $M_1$ and $M_2$ of the first assembly $I_1$-$I_2$ are disengaged, uprights $M_2$, $M_3$ and $M_4$ are removed and they are replaced by other lateral shift carriages 14', in a way which will be described in detail further on. At the height of these carriages, rails (not shown) have also been mounted on shoes for permitting shifting of the first assembly $I_1$-$I_2$ to the right.

Figure 5:
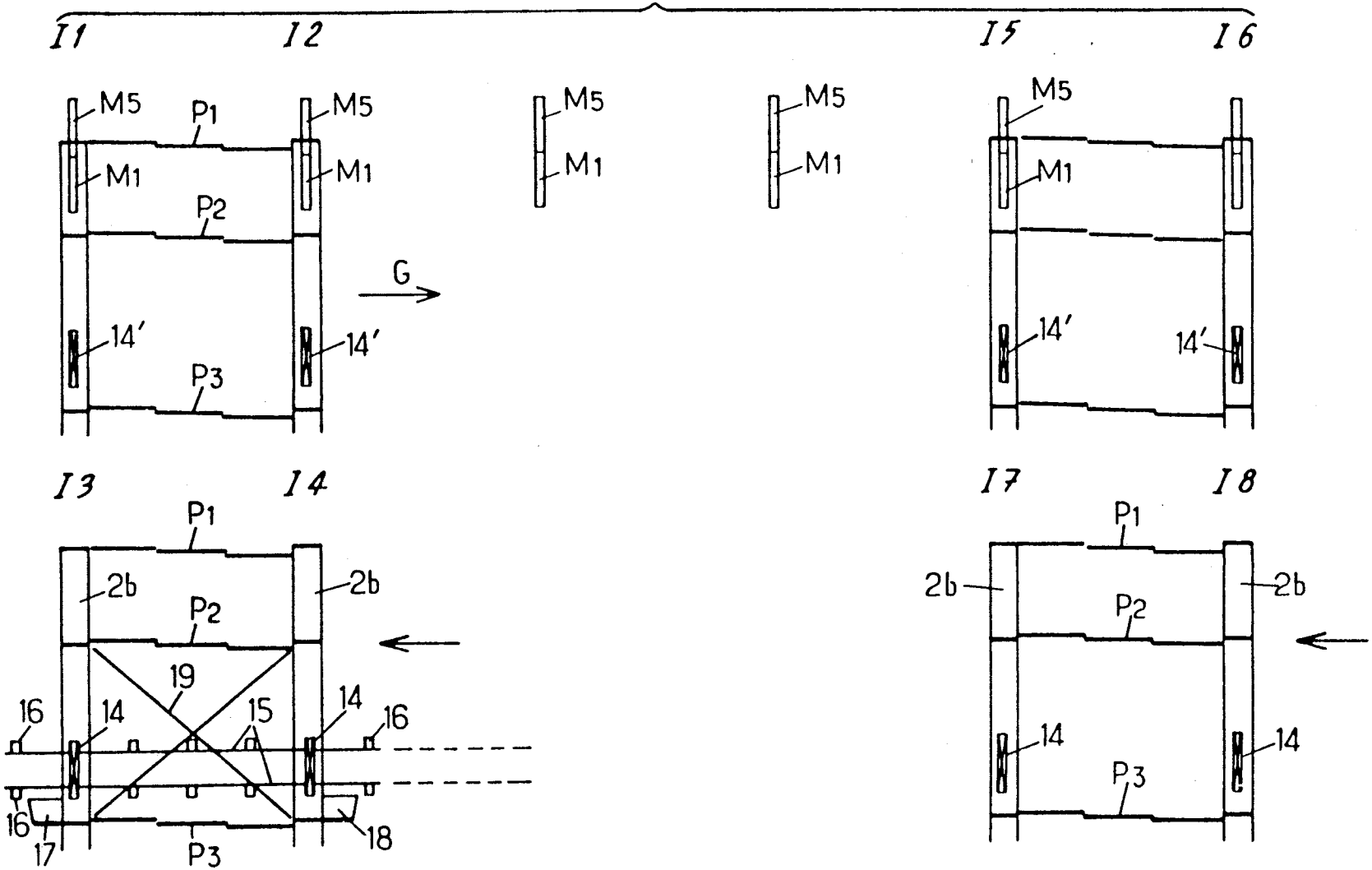

The third assembly $I_3$-$I_4$ is shifted to the left (see also arrow F in FIG. 7*b*) until its brackets arrive in the position referenced 2*b* in FIG. 5, in which they are exactly in the alignment of brackets 2 of the first assembly $I_1$-$I_2$ which has not yet moved.

We then arrive at the position shown in FIGS. 5, 8*a* and 8*b*, in which each third assembly $I_3$-$I_4$, $I_7$-$I_8$ . . . is located exactly below the corresponding first assembly respectively $I_1$-$I_2$, $I_5$-$I_6$ . . .

Figure 8B:
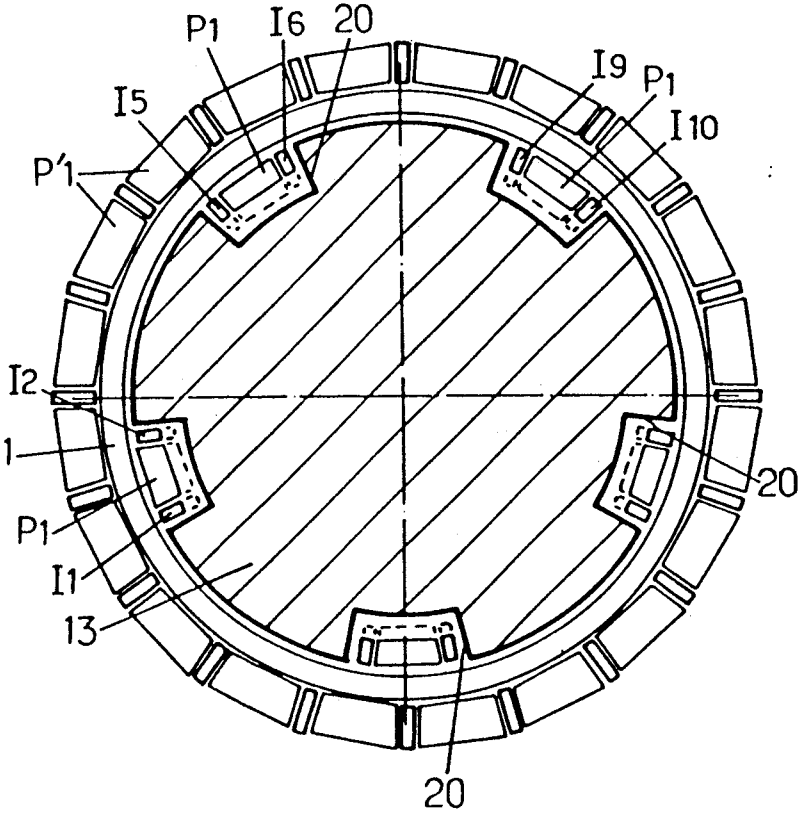
Figure 8A:
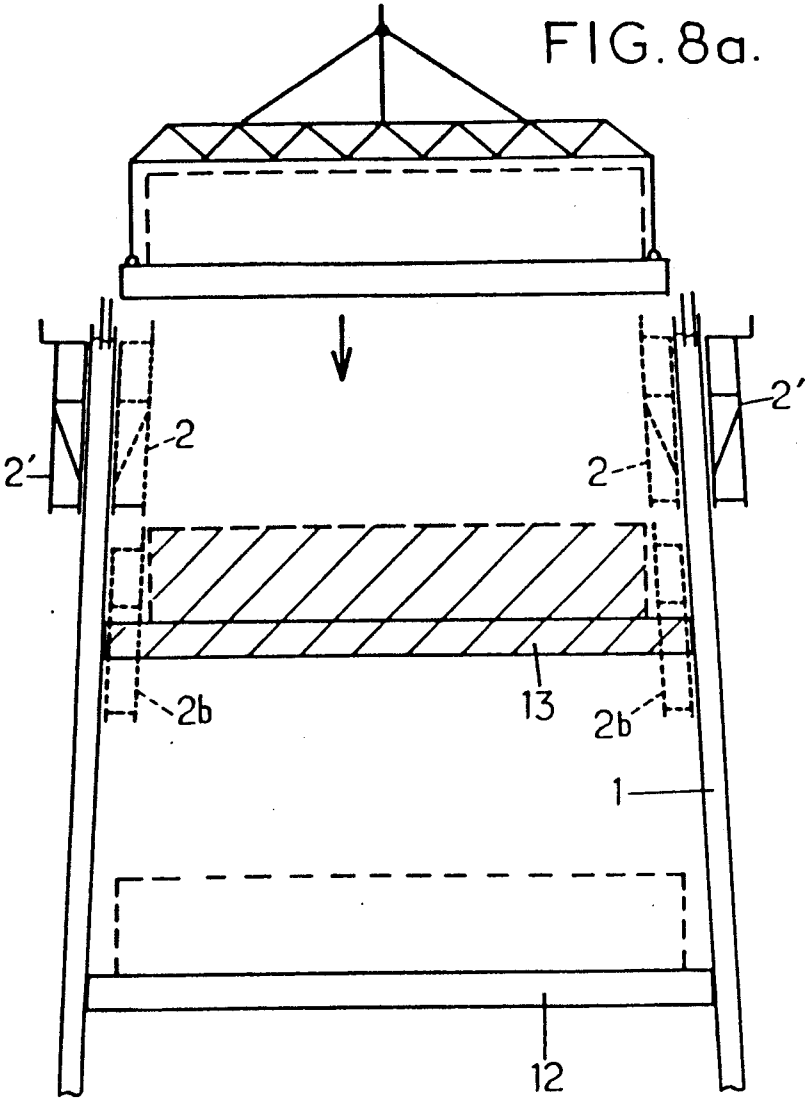
Figure 9B:
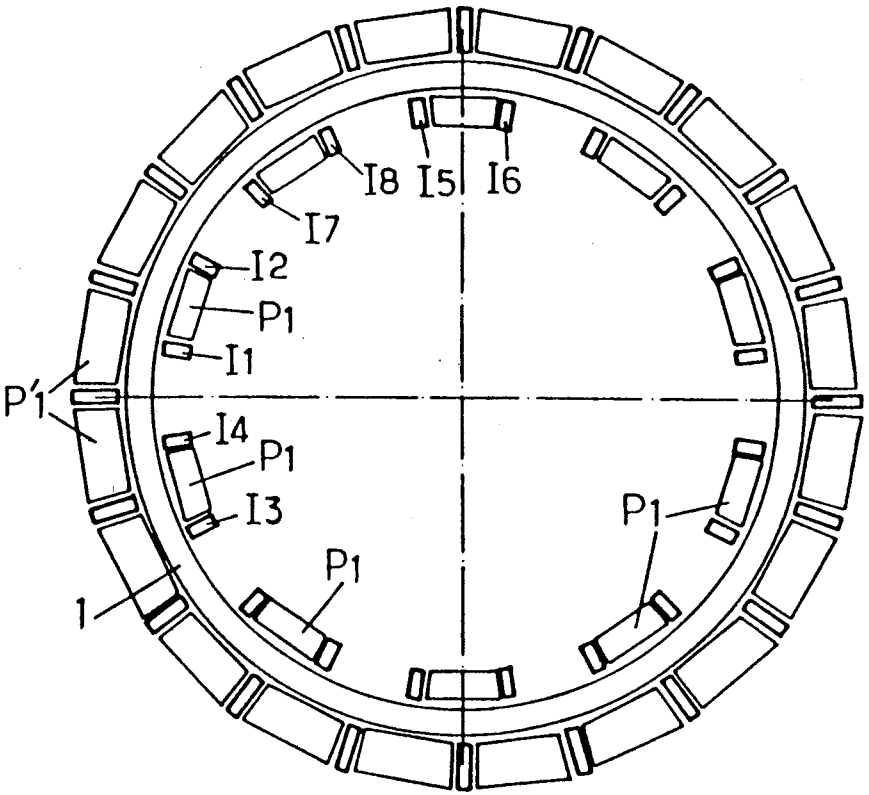
Figure 9A:
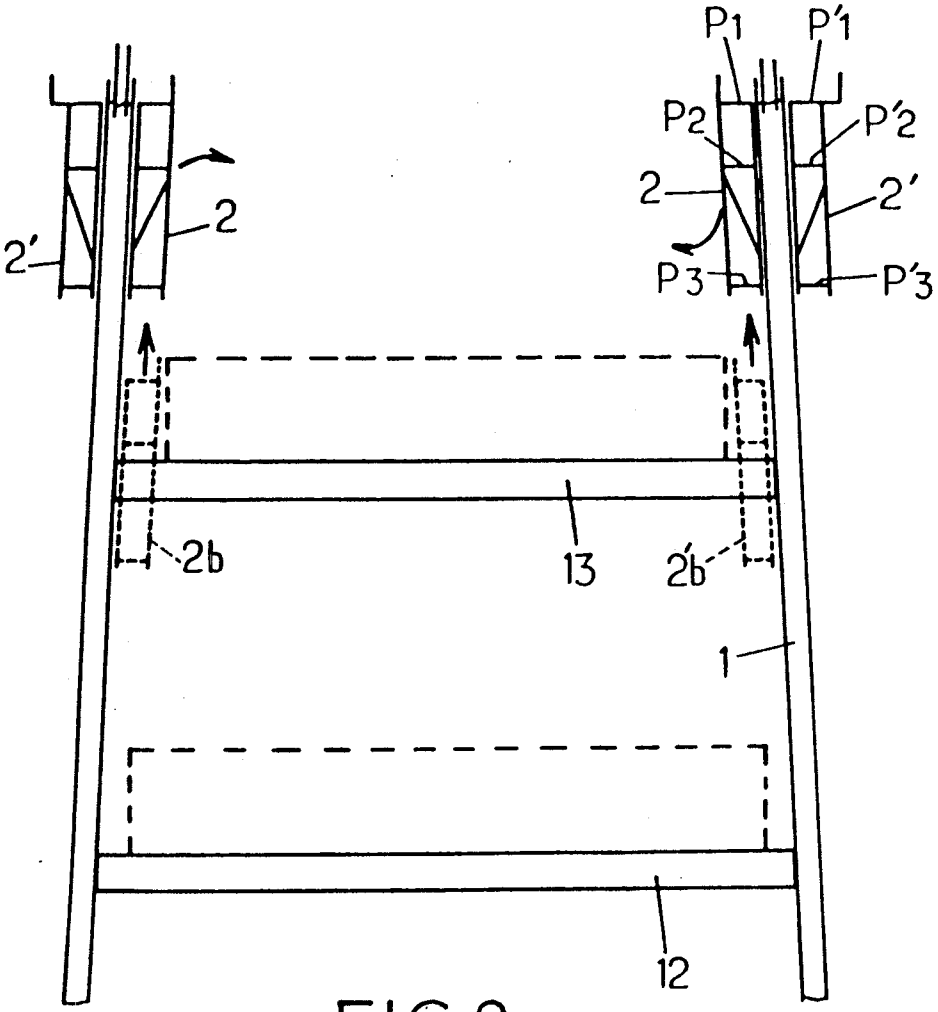
Figure 10B:
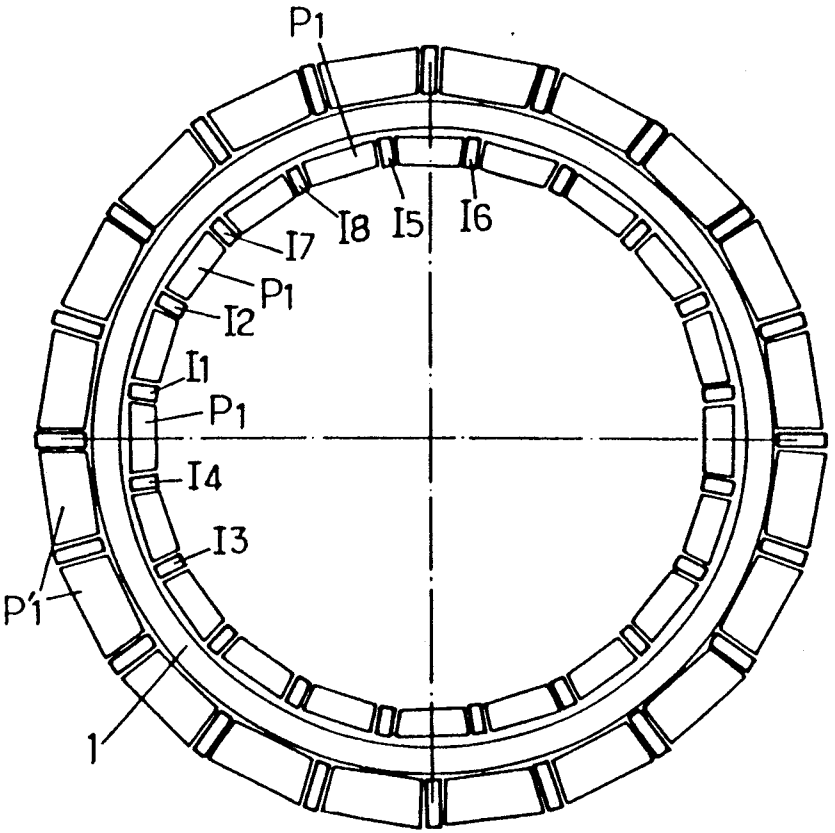
Figure 10A:
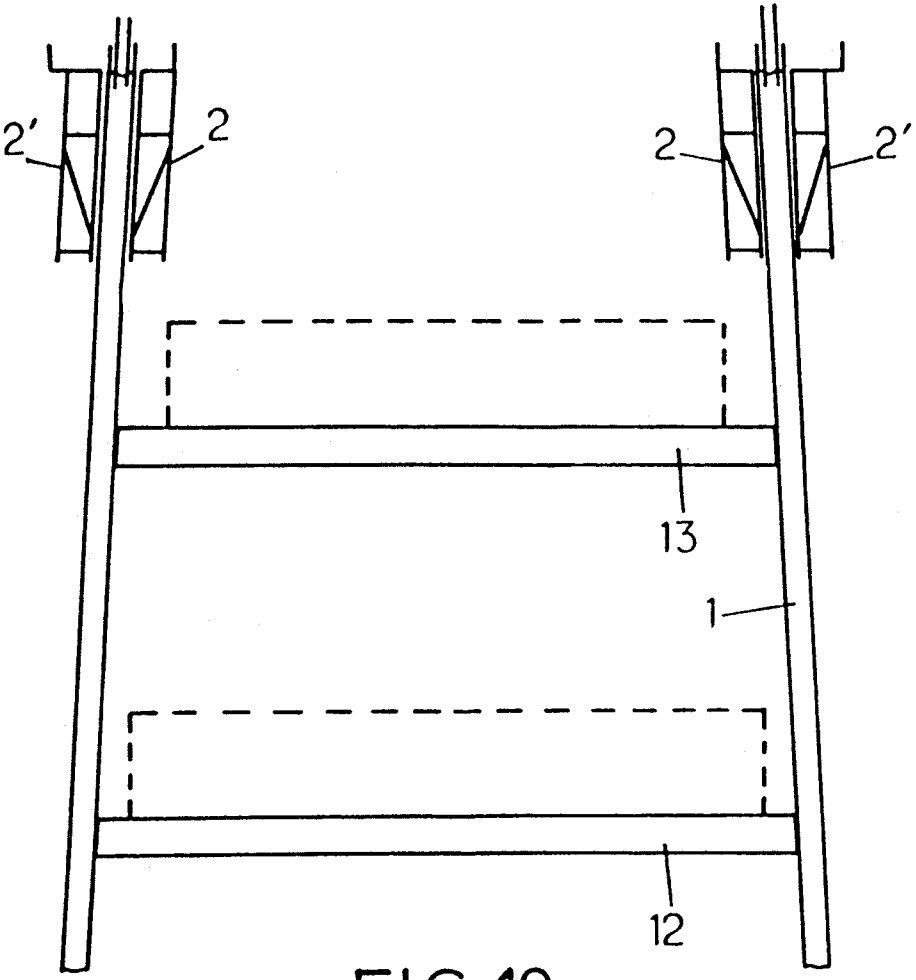

It can then be seen that it is sufficient to provide in floor 13 to be positioned only five evenly spaced apart clearances, referenced 20 in FIG. 8*b*, for this floor to be lowered to its position E and be fixed in the column, the superimposed assemblies in fact letting these clearances pass.

When this floor 13 has been positioned, the brackets and their walkways may be brought into the normal working position, for continuing erection of wall 1 as far as the next floor.

For this, using carriages 14' and the corresponding rails, the first assembly $I_1$-$I_2$ ($I_5$-$I_6$ . . . ) is first of all shifted laterally to the right (arrow G in FIG. 5) until it comes exactly into the position previously occupied by the third assembly $I_3$-$I_4$ ($I_7$-$I_8$ . . . ); the next uprights $M_2$ to $M_4$ of the first assembly $I_1$-$I_2$ thus transferred may then be connected to the lower uprights $M_1$ which have remained in position, carriages 14' being removed.

It should be noted here that during the different lateral translational movements which have just been described, rollers 9 of brackets 2 are retracted and they run on wall 1 through their rollers 11.

With the climbing system, and its carriages 14 removed, as well as the cross-bracing 19, the third assembly $I_3$-$I_4$ may then be raised, by fixing provisional intermediate uprights on wall 1, to the position—then freed—which the first assembly $I_1$-$I_2$ occupied previously (similarly for assembly $I_7$-$I_8$ which takes the position of assembly $I_5$-$I_6$ and so on). Uprights $M_2$ are connected to the respective uprights $M_1$. We then arrive at the position shown in FIGS. 9*a* and 9*b* in which all the brackets are in position, but with a permutation with respect to their previous positions, the order of the brackets then becoming $I_3$-$I_4$-$I_1$-$I_2$-$I_7$-$I_8$-$I_5$-$I_6$ etc.

It is then sufficient to reposition the sets of walkways $P_1$, $P_2$, $P_3$ between brackets $I_4$-$I_1$, $I_2$-$I_7$, $I_8$-$I_5$ etc. (figures 10*a* and 10*b*) to arrive at the same configuration as at the outset, and to be able to normally continue erection of the column.

For details of positioning carriages 14 and 14' providing lateral transfer of the brackets, reference should be made to figures 11*a* to 11*e*.

The operations on a single bracket 2 will be described hereafter, it being understood that the same operations take place at the same time on the other bracket 2 of the assembly in question.

The starting position will first of all be considered in which bracket 2 is engaged on the first upright $M_4$ of a series, with the fixed rest 6 on pin $B_2$ and the mobile rest 8 on pin $B_1$ of this upright (FIG. 11*a*), since it is a question of replacing the latter by a lateral displacement carriage 14'. The mobile rest 8 is first of all raised so as to be able to place it on pin $B_3$ of upright $M_3$, following which bracket 2 is raised so that its fixed rest 6 may bear on pin $B_4$ of this upright $M_3$. Upright $M_4$ may then be removed and replaced by a lateral displacement carriage 14' (FIG. 11*b*).

Rails 15 are then positioned on wall 1, except in line with brackets 2, continuity being provided at this level (at each end of carriage 14') by special shoes 30 fixed to wall 1 (see also FIGS. 12 to 14) and allowing the vertical passage, on each side, of the two arms 6*a* of the fixed rest 6. A provisional radial tensioner 21 is then fixed to pin $B_1$ of upright $M_3$ for retaining bracket 2 and so taking up the horizontal force in the radial direction of the fixed rest 6, which is then relieved of any force in this direction. Bracket 2 may then be lowered to the position in which its fixed rest 6 may bear on the pin, referenced $B_O$ of carriage 14', the mobile rest of course remaining supported on pin $B_3$ of upright $M_3$ (FIG. 11*c*). The tensioner 21 being then slackened, the support rollers 7 of the fixed rest 6 take up the horizontal forces.

In order then to disengage upright $M_3$ from wall 1, its lower connection 22 therewith is removed and the mobile rest 8 is lowered on to its pin $B_4$. A provisional horizontal bar 23 connects this upright $M_3$ to the mobile rest 8 (figure 11*d*). Then the upper connection 24 of upright $M_3$ with wall 1 is removed, which makes it possible to move it away from the wall (figure 11*e*) but leaving it connected to bracket 2 via the mobile rest 8, through the provisional bar 23.

Then the lateral displacement rails 15 are connected to the special shoes 30 for providing, at the top and bottom, the continuity of the lateral running track of the transfer carriage 14'. Finally, with the adjustment system 10, the lower support roller 9 of bracket 2 is moved away from wall 1, so as to transfer the bearing forces on the wall to the horizontal running roller 11, as has already been mentioned, following which the brackets 2 of the assembly considered, carried by carriages 14' may be moved over the rails 15.

FIGS. 12 to 14 show the constructional details of carriages 14 or 14'. They comprise a body formed of a stamped metal sheet box 29 having two flanges on which the rollers 7 of the fixed rest 6 bear. These carriages have at their lower part horizontal support rollers 25, 26 and vertical support rollers 27; in their upper part, horizontal support rollers 28. The latter are guided by a channel iron 31 of the upper shoe 30, whereas at the bottom, horizontal guidance is provided by roller 25 which may bear on wall 1 and by roller 26 which may bear on a vertical flange 32 of the lower shoe 30, the continuity of such guidance then being provided by rails 15.

I claim:

1. Method of mounting a floor in a shell having a periphery whose concrete wall is erected by a continuous self-climbing shuttering installation, said concrete wall being formed by successive lifts made along said periphery of said shell until a desired height is reached, said installation comprising essentially, on both an internal and an external face of said wall, means for momentarily fixing working walkways on an underlying portion of said wall already cast and hardened, means for shuttering a next lift on said underlying portion and climbing means for self-raising of said walkways, in which installation said fixing means comprise series of uprights ($M_1$ to $M_5$) extending substantially in vertical planes, lower uprights of which are anchored in said hardened concrete of said wall, said series being evenly spaced apart along said periphery of said wall (1), said uprights serving both as elements for holding shuttering in position and as means for guiding and engaging self-lifting mobile brackets (2, 2') supporting said walkways, which method comprises:

providing a floor (13) having a periphery and a series of evenly spaced apart clearances (20) at said periphery;

providing multiple assemblies for both said internal face and said external face of said wall, each assembly comprising said brackets (2) which are engaged on two adjacent series of uprights, and said walkways ($P_1$, $P_2$, $P_3$) supported by said brackets, and wherein on said internal face of said wall there are provided first assemblies ($I_1$-$I_2$), second assemblies ($I_2$-$I_3$), and third assemblies ($I_3$-$I_4$) which are adjacent to each other;

erecting said concrete wall of said shell by performing shuttering and concreting operations on both said internal face and said external face of said wall with said multiple assemblies;

interrupting said shuttering and concreting operations on said internal face of said wall; laying said walkways ($P_1$, $P_2$, $P_3$) of each of said second assemblies ($I_2$-$I_3$) on said walkways of one of said adjacent assemblies;

lowering said third assemblies ($I_3$-$I_4$) to a lower level than a level of said first assemblies ($I_1$-$I_2$);

laterally transferring said third assemblies ($I_3$-$I_4$) under said first assemblies ($I_1$-$I_2$);

laying said floor (13) in said shell by positioning said floor such that said clearances (20) of said floor pass said first assemblies ($I_1$-$I_2$) and said third assemblies ($I_3$-$I_4$) which have been superimposed.

laterally transferring said first assemblies ($I_1$-$I_2$) to respective positions occupied previously by said third assemblies ($I_3$-$I_4$);

mounting said third assemblies ($I_3$-$I_4$) to respective positions previously occupied by said first assemblies ($I_1$-$I_2$);

repositioning said walkways of said second assemblies ($I_4$-$I_1$); and continuing said shuttering and concreting operations until another floor (13) is to be laid on until said desired height of said concrete wall is reached.

2. Method according to claim 1, characterized in that said third assemblies ($I_3$-$I_4$) are lowered and then raised by fixing on said wall (1) an appropriate number of intermediate provisional uprights and by lowering or climbing said brackets (2) by means of their self-climbing means (6, 8), as during normal climbing

3. Method according to 1, characterized in that said lateral transfers of said third assemblies ($I_3$-$I_4$) or said first assemblies ($I_1$-$I_2$) of brackets (2) are made by means of lateral transfer carriages (14, 14') which are disposed at a position of said lower uprights of said series of corresponding uprights, said carriages supporting a weight of said brackets (2) and of said their walkways and being adapted for moving over rails (15) fixed provisionally to said wall (1).

4. Method according to claim 3, characterized in that said transfer carriages (14, 14') are positioned, before lateral displacement thereof, between two special shoes (30) fixed provisionally t said wall (1) and adapted for providing continuity of running with said rails (15).

5. Method according to claim 3, characterized in that, with said brackets (2) supported by last lower uprights ($M_4$) of said corresponding series of uprights, said brackets are provisionally raised for engaging said uprights, by their fixed (6) and mobile (8) rests, on immediately upper uprights ($M_3$) which allows said last lower uprights ($M_4$) to be removed and replaced by said lateral transfer carriages (14,14'), following which said brackets (2) are lowered so that said fixed rests (6) each bear on a pin ($B_O$) of corresponding transfer carriages (14,14').

* * * * *